US006026520A

United States Patent [19]

Pedersen

[11] Patent Number: 6,026,520

[45] Date of Patent: Feb. 22, 2000

[54] TOILET COVER ASSEMBLY

[75] Inventor: Kjeld Bruno Pedersen, Ny Kirkevej, Denmark

[73] Assignee: Pressalit A/S, Ry, Denmark

[21] Appl. No.: 09/101,323

[22] PCT Filed: Feb. 14, 1997

[86] PCT No.: PCT/DK97/00069

§ 371 Date: Jul. 7, 1998

§ 102(e) Date: Jul. 7, 1998

[87] PCT Pub. No.: WO97/29674

PCT Pub. Date: Aug. 21, 1997

[30] Foreign Application Priority Data

Feb. 14, 1996 [DK] Denmark ..... 0153/96

[51] Int. Cl.[7] ..... A47K 13/12

[52] U.S. Cl. ..... 4/236; 4/248

[58] Field of Search ..... 4/236, 240, 248

[56] References Cited

U.S. PATENT DOCUMENTS

| | | | |
|---|---|---|---|
| 2,431,263 | 11/1947 | Lundgren | 4/236 |
| 3,032,777 | 5/1962 | Young | 4/240 |
| 3,261,029 | 7/1966 | Beneke, Jr. | 4/236 |
| 3,590,401 | 7/1971 | Brown | 4/236 |
| 4,197,596 | 4/1980 | Fantetti | 4/236 |
| 4,680,816 | 7/1987 | Colombani | 4/240 |
| 5,279,000 | 1/1994 | Mercier et al. | 4/240 |
| 5,390,770 | 2/1995 | Miyahara et al. | 188/307 |

FOREIGN PATENT DOCUMENTS

| | | |
|---|---|---|
| 3119622 | 11/1984 | Germany . |
| 9115984 | 10/1991 | WIPO . |

*Primary Examiner*—Robert M. Fetsuga
*Attorney, Agent, or Firm*—Ladas & Parry

[57] ABSTRACT

A toilet cover assembly comprises a seat (1) and a cover (2) each being pivotally connected with a bracket (3) adapted to be fastened to a toilet bowl by means of two interspaced hinges (6,7). The seat (1) and the cover (2) are pivotally interconnected by means of two interspaced hinges of the pin-b earing type, each comprising a hinge member (6) fixedly secured to the seat (1) and a hinge member (7) fixedly secured with the cover (2). One of the hinge members (6) is provided with a protruding pin (9), whereas the other hinge member (7) is provided with a bearing (12) for receiving said pin (9). The hinge members (6) fixedly secured to the seat (1) and the cover (2) respectively are arranged such that the hinge pins (9) can be brought into and out of engagement with the hinge bearings by axial displacement of the seat (1) relative to the cover (2) when the seat (1) and the cover (2) are detached from the bracket (3).

9 Claims, 3 Drawing Sheets

TOILET COVER ASSEMBLY

TECHNICAL FIELD

The invention relates to a toilet cover assembly comprising a seat and a cover, each being pivotally connected with a bracket about a common axis by means two interspaced hinges, said bracket provided with fastening means for fastening the bracket to a toilet bowl and said toilet cover assembly further provided with means for releasably connecting the cover and the seat with the bracket.

BACKGROUND ART

DE-C2-31 19 622 discloses a toilet cover assembly of the above type, in which the seat and the cover each is provided with two interspaced hinge bearings, the hinge bearings of the cover being slightly more interspaced than the hinge bearings of the seat. The bracket is provided with two hinge pins each displaceable between a position in which they engage each of the adjacent bearings and a position in which they disengage said bearings. The seat and the cover is not hingedly interconnected, when they are detached from the bracket. As a result, when mounting the seat and the cover on the bracket, the hinge bearings of the seat and cover are to be accurately aligned with each other and with the two hinge pins, and at the same time the two hinge pins are to be moved into the engagement position with the hinge bearings. This is not a simple task for a single person.

BRIEF DESCRIPTION OF THE INVENTION

The object of the invention is to provide a toilet cover assembly of the above type facilitating the release and in particular the fastening of the seat and the cover to the bracket.

The toilet cover assembly according to the invention is characterised in that the seat and the cover are pivotally interconnected by means of two interspaced hinges of the pin/bearing type each comprising a hinge member fixedly secured to the seat and a hinge member fixedly secured to the cover, one of the hinge members provided with a protruding pin and the other hinge member provided with a bearing for receiving the pin, said seat hinge members and cover hinge members being arranged such on the seat and the cover respectively that the hinge pins can be brought into and out of engagement with the hinge bearings by axial displacement of the seat relative to the cover when the seat and the cover are detached from the bracket and that the connecting means for releasably connecting the seat and the cover to the bracket are adapted to releasably connect the bracket with an immediately adjacent hinge member and an immediately adjacent cover hinge member respectively. As a result, the seat and cover are easily attached to and detached from the bracket. When connecting the seat and the cover with the bracket, the pin/bearing-type hinges of the seat and the cover are aligned and the seat and the cover are subsequently mutually axially displaced to bring the pins and bearings of the hinges into interengagement. An assembly is thus obtained, wherein the seat and the cover both are arranged correctly relative to each other due to their mutual hinge connection. The assembly of the seat and the cover can then be connected with the bracket without difficulty, the correct mutual position of the seat and the cover as stated ensured by the hinge connection. Correspondingly, when detaching the seat and the cover from the bracket, these are also hingedly interconnected as an assembly and when detached from the bracket the seat and cover can be separated by displacing them axially relative to each other such that the pins and bearings of the hinges are brought out of engagement with one another. Subsequently hereto the seat and the cover can advantageously be cleaned individually prior to being re-interconnected and attached to the bracket as an assembly.

As the seat and the cover each are provided with a hinge member adjacent the bracket, the toilet cover assembly according to the invention is further advantageous in connection with embodiments comprising a damper for damping the movement of the seat and the cover from the raised position to the lowered position in that the damper advantageously may be easily arranged in the bracket or in the adjacent hinge member of the seat and the cover respectively. At the same time, the seat from the cover are readily separated from each other and quickly interconnected as well as attached to and detached from the bracket.

According to the invention the seat and the cover can each comprise a hinge member provided with a pin and a hinge member provided with a bearing. Thereby, the hinge pin members of the seat and the cover as well as the hinge bearing members thereof can be identically shaped so as to facilitate the production thereof.

Moreover, according to the invention the hinge member of the seat as well as of the cover arranged immediately adjacent the bracket can be a hinge pin member, whereby the hinge pins extend outwardly in the direction away from the bracket and thus provide a large interspace between the hinge points. However, naturally, it is also possible to form the hinge arrangement such that the hinge member of both the seat and the cover arranged immediately adjacent the bracket is a hinge bearing member.

Furthermore, according to the invention the connecting means for releasably connecting the seat and the cover with the bracket can comprise a pin arranged axially displaceably between the hinge member immediately adjacent the bracket of the seat and the cover, respectively and the bracket, said pin adapted for a displacement between an engagement position and a release position. As the seat and the cover are separately hinged to one another and the pin is not part of this hinge arrangement, the travel distance of the pin between the engagement position and the release position is reduced.

In this connection, according to yet another embodiment of the invention the displaceable pin can be arranged axially displaceable relative to the hinge member of the seat and of the cover, respectively immediately adjacent the bracket and adapted for a displacement between an engagement position in which it engages a corresponding axial recess in the bracket and a release position in which it disengages said recess.

In order to facilitate the mounting and to ensure that the intended engagement is obtained and maintained, each of the displaceable pins can advantageously be springloaded towards its engagement position.

Moreover, according to the invention an activation means can be provided connected to each of the displaceable pins and adapted when activated in axial direction to advance the displaceable pin from the engagement position to the release position.

Furthermore, according to the invention the bracket can comprise a housing accommodating at least one shaft arranged pivotable about the hinge axis and provided with a damper means and shaft end portions facing the adjacent hinge members, the connecting means being adapted to releasably connect each of the shaft end portions with the adjacent hinge members. Optionally, each of hinge members immediately adjacent the bracket can comprise a housing accommodating a shaft arranged pivotable about the hinge members and provided with a damping arrangement and a shaft end portion facing the bracket, whereby the connecting means are adapted to releasably connect the shaft end portions with the bracket.

Finally, according to the invention the damper means can comprise a vane arranged pivotally in a part-cylindrical cavity formed in the bracket housing and filled with a highly viscous fluid. When providing the damping arrangement in the hinge members immediately adjacent the bracket, the part-cylindrical cavity is formed in the said hinge members.

BRIEF DESCRIPTION OF THE DRAWINGS

The invention is explained in detail below with reference to the drawings, in which.

BEST MODE FOR CARRYING OUT THE INVENTION

Figure 1:
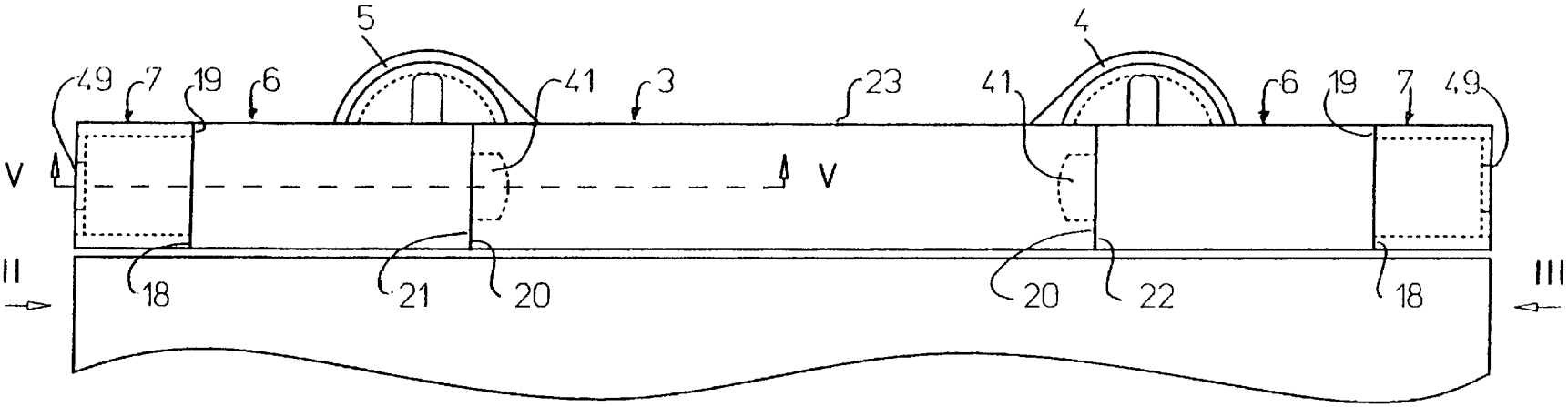
FIG. 1 is a top view of a toilet cover assembly according to the invention in its assembled state.
Figure 2:
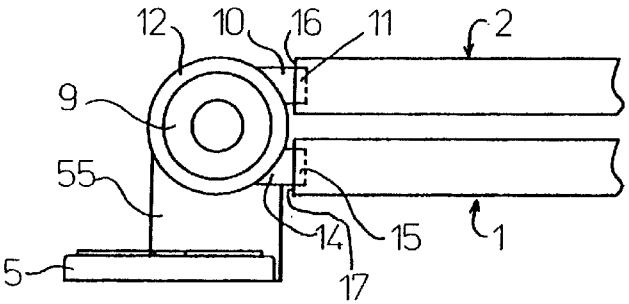
FIG. 2 illustrates the toilet cover assembly in FIG. 1 seen in the direction II in FIG. 1.
Figure 3:
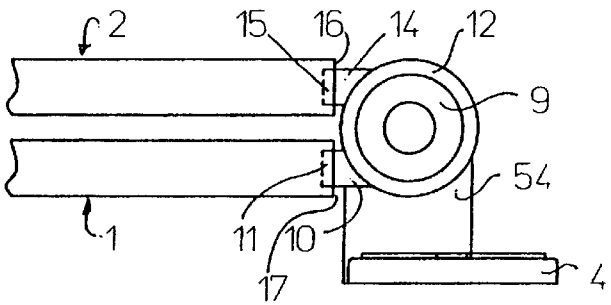
FIG. 3 illustrates the toilet cover assembly in FIG. 1 seen in the direction III in FIG. 1.

The shown toilet cover assembly comprises a seat 1 and a cover 2 hingedly interconnected and pivotally connected with a bracket 3 provided with a housing 23 having two legs 54,55 with bases 4,5 by means of which the bracket 3 can be fastened to a toilet bowl in a known manner.

The seat 1 and the cover 2 are hingedly interconnected by means of two interspaced hinges, each comprising a hinge member 6 provided with a pin and a hinge member 7 provided with a bearing. The hinge pin members 6 each comprises a cylindrical body 8 having an axially projecting pin 9, and a leg 10 extending substantially tangentially from the body 8 and ending in a mounting base 11. The hinge bearing members 7 each comprises a bearing 12 provided with a cylindrical cavity 13 adapted to receive the pin 9 of the hinge pin member 6 and a leg 14 extending substantially tangentially from the bearing and ending in a mounting base 15. The hinge pin members are identical as are the hinge bearing members.

Figure 4:
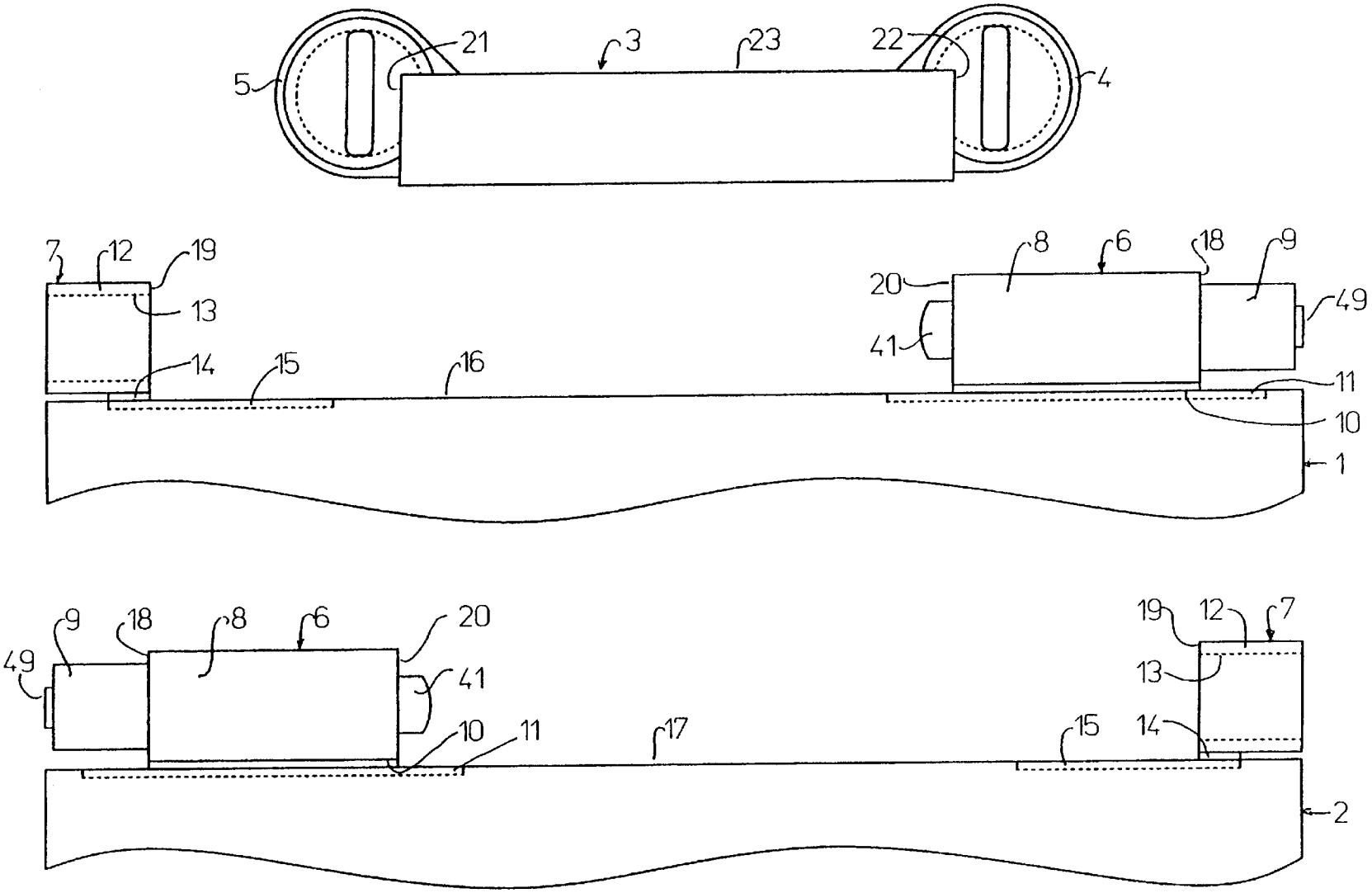
FIG. 4 illustrates the toilet cover assembly in FIG. 1, in which the seat and the cover are separated and detached from the bracket.

As illustrated in FIG. 4, a hinge bearing member 7 is mounted on the rear edge 16 of the seat at one end and a hinge pin member 6 is mounted at the other end co-axially thereto, the pin 9 facing outwards. The mounting base 15 of the hinge bearing member 7 and the mounting base 11 of the hinge pin member are both countersunk in the rear edge 16 of the seat 1. Correspondingly, a hinge pin member 6 with the pin 9 facing outwards is mounted at one end in the rear edge 17 of the cover 2 and a hinge bearing member 7 is mounted at the other end co-axially therewith. The mounting base 11 of the hinge pin member 6 and the mounting base 15 of the hinge bearing member 7 are both countersunk in the rear edge 17 of the cover.

As illustrated in FIGS. 1 and 4, the hinge members 6,7 of the hinges are mounted such on the seat 1 and the cover 2 respectively that the pins 9 of the hinge pin members 6 can be brought into and out of engagement with the cavities 13 of the hinge bearing members 7 by an axial displacement of the cover 2 relative to the seat 1 when the seat 1 and the cover 2 are detached from the bracket 3. Furthermore, the hinge members are arranged such that when the pins 9 are in engagement with the bearings 12, a shoulder 18 between the body of the hinge pin members and the pin 9 essentially abuts an inwardly facing edge face 19 of the bearings 12. In said engagement position, the distance between the inwardly facing end faces 20 of the body 8 of the hinge pin members 6 corresponds substantially to the distance between the end faces 21, 22 of the housing 23 facing away from each other.

The shape of the housing 23 of the bracket 3 which is symmetrical about a central wall 24 is explained in detail below with reference to FIGS. 5 and 6. A shaft 25 is pivotally arranged in the interior of the housing 23 and prevented from axial displacement due to the abutment between an inner end face 27 thereof and the central wall 24 and the abutment between a shoulder 28 thereof and an inwardly extending projection 29 of the housing. An axial recess 31 having a cross-section not presenting rotation symmetry is provided in the outer end face 30 of the shaft, said face being substantially in the same plane as the end face 21 of the bracket housing 23.

The shaft 25 is further provided with a radially annular projection 33 having an annular groove 34 accommodating a sealing ring 35 sealingly abutting the inner surface 36 of the bracket housing 23. A closed compartment is thus formed between the radial projection 33 and the central wall 34 and filled with a highly viscous fluid so as to form a damper. In a known manner, the damper further comprises a rib 37 extending radially inwards from the housing and substantially to the shaft 25, and a vane 38 extending radially outwards from the shaft and-substantially to the inner surface 36 of the housing. Finally, the damper is provided with a one-way valve member (not shown) allowing for a flow of fluid between the two chambers formed by the vane 38 and the rib 37 when the shaft rotates in one direction and essentially preventing said flow of fluid when the shaft rotates in the opposite direction. As a result, the shaft is rotatable in said first direction substantially without any resistance, while a certain predetermined resistance prevents the shaft from rotating in the opposite direction.

Figure 5:
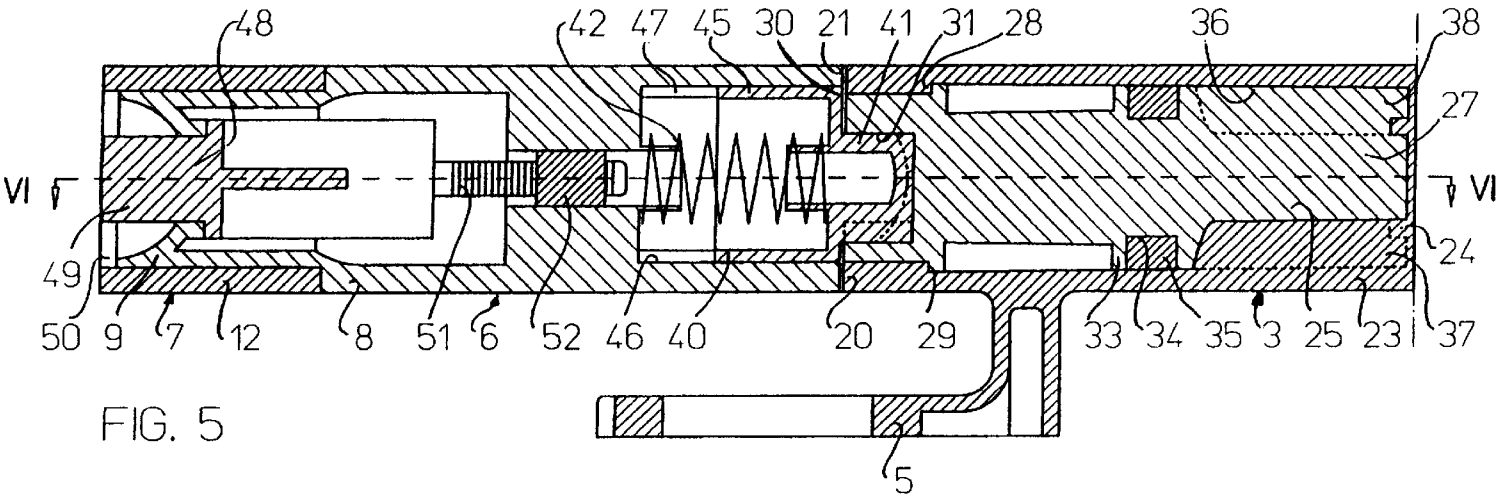
FIG. 5 is diagrammatic sectional view along the line V—V in FIG. 1.
Figure 6:
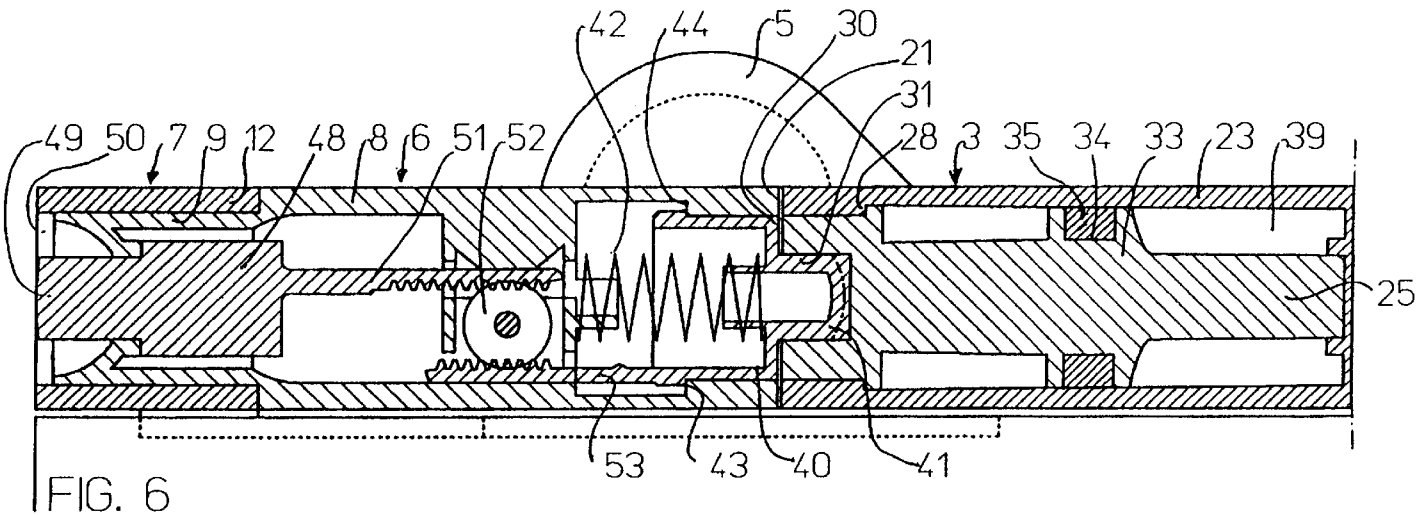
FIG. 6 is diagrammatic sectional view along the line VI—VI in FIG. 5.

As illustrated in FIGS. 5 and 6, each of the hinge pin members 6 immediately adjacent the bracket 3 has a hollow interior. A substantially cup-shaped body 40 provided with a projecting pin 41 and having a cross section not presenting rotation symmetry is displaceably arranged in the interior of the hinge pin member 6 at the end thereof immediately adjacent the bracket 3. The body 40 is preloaded to adopt the engagement position with the recess 31 in the shaft 25 shown in FIGS. 5 and 6 by means of a compression spring 42. In the shown engagement position a stop face 43 of the cup-shaped body 40 abuts an inner stop face 44 of the body 8 of the hinge pin member 6. The body 40 is prevented from rotating by an outer rib 45 on the cylindrical wall 46 of the body received in a corresponding groove 47 in the body 8 of the hinge pin member 6. Against the force of the compression spring 42 the pin 41 of the body 40 can be moved from the engagement position shown in FIGS. 5 and 6 to a release position in which it no longer extends beyond the inwardly facing end face 20 of the hinge pin member 6, whereby the hinge pin members 6 and the hinge bearing members 7 connected therewith and thus the seat and the cover can be detached from the bracket 3.

For bringing the pin 41 out of said engagement position the hinge pin member 6 is provided with an activation mechanism comprising an activation body 48 displaceably arranged in the interior of the hinge pin member 6 and an activation button 49 extending beyond the outer end face 50 of the pin 9 of the hinge pin member 6. At the other end, the activation body 48 is provided with a rack 51 meshing with a gear wheel 52 pivotally arranged in the interior of the hinge pin member 6. The gear wheel 52 further engages a second rack 53 connected with the cup-shaped body 40 provided with the pin 41. When pressing the activation button 49 the rack 51 rotates the gear wheel 52 which in turn displaces the second rack 53 in opposite direction of the rack 51 and thus advances the cup-shaped body 40 provided with the pin 41 toward the release position. The force of the compression spring causes the activation button 49—when released—to revert to its initial position shown in FIGS. 5 and 6 in which the pin 42 is in the engagement position.

When the pin 41 of the body 40 is in engagement with the recess 31 of the shaft 25, the shaft 25 rotates at rotation of the hinge pin member 6 and the cover 2 connected therewith due to the non-pivotal connections between the pin 41 and the recess 31 and between the body 40 and the body 8 of the hinge pin member 6. This rotation is performed with damping when lowering the cover 2 and without resistance when raising said cover. As the shape of the housing 23 of the bracket is symmetrical and the hinge pin member connected with the seat 1 is attached to the opposite end of the bracket as described above, the movement of the seat 1 from its raised position to its lowered position is also dampened.

The invention may be modified in many ways without thereby deviating from scope of the invention. The bracket can thus comprise two separate bracket members, each of which being mounted on the toilet bowl. The separate bracket members can as the illustrated and described bracket 3 be arranged between the hinge members of the seat and the cover. They can, however, also be arranged at the outside of said members. Finally, one of the bracket members can be arranged between the hinge members and the second bracket member is arranged at the outside thereof.

I claim:

1. A toilet cover assembly comprising a seat (1) and a cover (2), each pivotally connected with a bracket (3) about a common axis by means two interspaced hinges (6,7), said bracket provided with fastening means for fastening the bracket to a toilet bowl and said toilet cover assembly further provided with means for releasably connecting the cover (2) and the seat (1) with the bracket (3), characterised in that the seat (1) and the cover (2) are pivotally interconnected by means of two interspaced hinges of the pin/bearing type, each comprising a hinge member (6) fixedly secured to the seat (1) and a hinge member (7) fixedly secured to the cover (2), one of the hinge members (6) provided with a protruding pin (9) and the other hinge member (7) provided with a bearing (12) for receiving the pin, said seat hinge members and cover hinge members being arranged such on the seat (1) and the cover (2) respectively that the hinge pins (9) can be brought into and out of engagement with the hinge bearings (12) by axial displacement of the seat (1) relative to the cover (2) when the seat (1) and the cover (2) are detached from the bracket (3) and that the connecting means for releasably connecting the seat (1) and the cover (2) with the bracket (3) are adapted to releasably connect the bracket (3) with an immediately adjacent seat hinge member (6) and an immediately adjacent cover hinge member (6) respectively.

2. A toilet cover assembly according to claim 1, characterised in that both the seat and the cover comprises a hinge member (6) provided with a pin and a hinge member (7) provided with a bearing.

3. A toilet cover assembly according to claim 2, characterised in that the hinge member of the both the seat (1) and the cover (2) immediately adjacent the bracket is a hinge member (6) provided with a pin (9).

4. A toilet cover assembly according to claim 1 characterised in that the connecting means for releasably connecting the seat (1) and the cover (2) with the bracket (3) comprise a pin (41) arranged axially displaceably between the hinge member (6) of the seat (1) and of the cover (2) respectively immediately adjacent the bracket (3) and the bracket (3), said pin (41) adapted for a displacement between an engagement position and a release position.

5. A toilet cover assembly according to claim 4, characterised in that the displaceable pin (41) is arranged axially displaceable in the hinge member (6) of the seat (1) and of the cover (2) respectively immediately adjacent the bracket (3) and adapted for a displacement between an engagement position in which it engages a corresponding axial recess (31) in the bracket (3) and a release position in which it disengages said recess (31).

6. A toilet cover assembly according to claim 4, characterised in that each of the displaceable pins (41) is spring-loaded towards its engagement position.

7. A toilet cover assembly according to claim 4, characterised in that an activation means (48,51,52,53,40) is provided connected to each of the displaceable pins (41) and adapted to advance the displaceable pin (41) from the engagement position to the release position when activated in axial direction.

8. A toilet cover assembly according to claim 1, characterised in that the bracket comprises a housing (23) accommodating at least one shaft (25) arranged pivotally about the hinge axis and provided with a damper means (38) and shaft end portions facing the adjacent hinge members (6), the connecting means being adapted to releasably connecting each of shaft end portions with the adjacent hinge members (6).

9. A toilet cover assembly according to claim 8, characterised in that the damper means comprises a vane (38) arranged pivotally in a part-cylindrical cavity (39) formed in the bracket housing and filled with a highly viscous fluid.

* * * * *